US012187488B2

(12) United States Patent
Voelker

(10) Patent No.: US 12,187,488 B2
(45) Date of Patent: Jan. 7, 2025

(54) PACKAGING ASSEMBLIES FOR PRODUCT COMPONENTS, AND RELATED METHODS

(71) Applicant: Monsanto Technology LLC, Saint Louis, MO (US)

(72) Inventor: Scott C. Voelker, St. Louis, MO (US)

(73) Assignee: MONSANTO TECHNOLOGY LLC, Saint Louis, MO (US)

( * ) Notice: Subject to any disclaimer, the term of this patent is extended or adjusted under 35 U.S.C. 154(b) by 61 days.

(21) Appl. No.: 17/673,746

(22) Filed: Feb. 16, 2022

(65) Prior Publication Data

US 2022/0267049 A1 Aug. 25, 2022

Related U.S. Application Data

(60) Provisional application No. 63/152,507, filed on Feb. 23, 2021.

(51) Int. Cl.
*B65D 19/38* (2006.01)
*B65D 19/10* (2006.01)

(52) U.S. Cl.
CPC ..... *B65D 19/38* (2013.01); *B65D 19/10* (2013.01); *B65D 2519/00024* (2013.01);
(Continued)

(58) Field of Classification Search
CPC .... B65D 19/38; B65D 19/10; B65D 71/0096; B65D 71/00; B65D 25/04; B65D 19/0006; B65D 2519/00512
(Continued)

(56) References Cited

U.S. PATENT DOCUMENTS

D297,619 S 9/1988 Cheval et al.
D313,687 S 1/1991 Cheval et al.
(Continued)

FOREIGN PATENT DOCUMENTS

DE 3928031 A1 * 2/1991
DE 19838309 A1 * 3/2000 ..... B65D 77/0466
(Continued)

OTHER PUBLICATIONS

Snydernet, "Dualtainer Two-Tank IBC Tote" Cached from Jul. 21, 2018 on web.archive.org (https://web.archive.org/web/20180721132332/https://www.snydernet.com/products/Snyder-ibc-totes/dualtainer) (Year: 2018).

*Primary Examiner* — Rafael A Ortiz
(74) *Attorney, Agent, or Firm* — Harness, Dickey & Pierce, P.L.C.

(57) ABSTRACT

A packaging assembly is provided for holding multiple different product components, where the different product components are usable together to form a product. The packaging assembly includes a base and at least one sidewall coupled to the base. A first compartment is disposed generally above the base and is configured to hold a first component. A second compartment is disposed generally above the first compartment and is configured to hold a second component. The packaging assembly also includes a divider positioned between the first and second compartments, a lid disposed generally over the second compartment, at least one securing device configured to secure the lid to the at least one sidewall, and at least one cross member disposed generally above the lid which is coupled to the at least one sidewall.

18 Claims, 15 Drawing Sheets

(52) U.S. Cl.
CPC ..... *B65D 2519/00034* (2013.01); *B65D 2519/00164* (2013.01); *B65D 2519/00199* (2013.01); *B65D 2519/00208* (2013.01); *B65D 2519/00512* (2013.01)

(58) Field of Classification Search
USPC ..... 206/386
See application file for complete search history.

(56) References Cited

U.S. PATENT DOCUMENTS

| | | | | |
|---|---|---|---|---|
| D316,320 | S | 4/1991 | Roser | |
| D320,255 | S | 9/1991 | Waltke et al. | |
| 5,595,318 | A * | 1/1997 | Barno | B65D 77/0466 220/1.5 |
| D414,333 | S | 9/1999 | Barber et al. | |
| D418,196 | S | 12/1999 | Faltys et al. | |
| D422,770 | S | 4/2000 | Schmitt | |
| 7,878,327 | B2 | 2/2011 | Cassina | |
| D688,350 | S | 8/2013 | Oren | |
| 8,505,722 | B1 | 8/2013 | Butruille et al. | |
| 8,646,641 | B2 * | 2/2014 | Moir | B65D 88/128 220/23.91 |
| RE45,914 | E | 3/2016 | Oren et al. | |
| 10,189,623 | B2 | 1/2019 | Voelker | |
| 10,875,696 | B2 * | 12/2020 | Schütz | B65D 77/0466 |
| 2007/0102314 | A1 * | 5/2007 | Dedmon | B65D 77/061 206/386 |
| 2013/0193031 | A1 | 8/2013 | Buturuille et al. | |
| 2016/0137407 | A1 * | 5/2016 | Skeid | B65D 19/10 206/386 |
| 2016/0312423 | A1 | 10/2016 | Kohn | |
| 2019/0225400 | A1 | 7/2019 | Weyrauch et al. | |
| 2020/0346908 | A1 * | 11/2020 | Macalus | B65D 19/06 |

FOREIGN PATENT DOCUMENTS

| | | | |
|---|---|---|---|
| KR | 200438174 | Y1 * | 11/2006 |
| WO | WO2011/106698 | | 9/2011 |
| WO | WO2012085940 | A2 | 6/2012 |

* cited by examiner

PACKAGING ASSEMBLIES FOR PRODUCT COMPONENTS, AND RELATED METHODS

CROSS-REFERENCE TO RELATED APPLICATION

This application claims the benefit of, and priority to, U.S. Provisional Application No. 63/152,507, filed on Feb. 23, 2021. The entire disclosure of the above application is incorporated herein by reference.

FIELD

The present disclosure generally relates to packaging assemblies and related methods, and more particularly, to packaging assemblies having compartments suitable for containing (or holding, storing, etc.) multiple different product components together within the assemblies (e.g., where the multiple different product components are usable together to make common products, etc.) and methods related making and using the assemblies.

BACKGROUND

This section provides background information related to the present disclosure which is not necessarily prior art.

Containers are used to hold, store, transport, etc. a variety of materials, including, for example, bulk fluid materials. The containers, then, are often loosely stacked on pallets for ease of transport. Furthermore, it is known for the bulk fluid materials held, stored, transported in the containers to include mixtures of more than one component, whereby the mixtures are transported in the containers.

SUMMARY

This section provides a general summary of the disclosure, and is not a comprehensive disclosure of its full scope or all of its features.

Example embodiments of the present disclosure generally relate to packaging assemblies for holding two or more different product components. In one example embodiment, a packaging assembly generally includes a base and at least one sidewall coupled to the base. A first compartment is disposed adjacent (e.g., generally above, etc.) the base and is configured to hold at least a first component. A second compartment is disposed adjacent (e.g., generally above, etc.) the first compartment and is configured to hold at least a second component. The packaging assembly also includes a divider positioned between the first and second storage compartments, a lid disposed generally over the second compartment, at least one securing device configured to secure the lid to the at least one sidewall, and at least one cross member disposed generally above the lid and coupled to the at least one sidewall for use in retaining the lid on the packaging assembly.

In another example embodiment, a packaging assembly for two or more different product components generally includes a base and at least one sidewall coupled to the base. The packaging assembly also includes at least one first container configured to hold a first component and at least one second container configured to hold a second component. The at least one first container and the at least one second container are both disposed within a boundary defined by the at least one sidewall. The first component is different than the second component and the first and second components are usable together (e.g., as a formulation).

Further, a divider is positioned between the at least one first container and the at least one second container, and is coupled to the at least one sidewall and configured to support the at least one second container.

Example embodiments of the present disclosure also generally relate to methods of making packaging assemblies for holding two or more different product components, where the two or more different product components are usable together to form a product. In one example embodiment, such a method generally includes coupling at least one sidewall to a base of the packaging assembly to thereby define a boundary for holding the two or more product components generally within a perimeter of the base; positioning at least one first container generally on the base such that the base supports the at least one first container, the at least one first container configured to hold a first component; positioning a divider generally above the at least one first container; positioning at least one second container generally on the divider such that the divider supports the at least one second container, the at least one second container configured to hold a second component; coupling, via at least one securing device, a lid to the at least one sidewall generally above the at least one second container; and coupling at least one cross member to the at least one side wall generally above the lid, to thereby retain the lid on the packaging assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
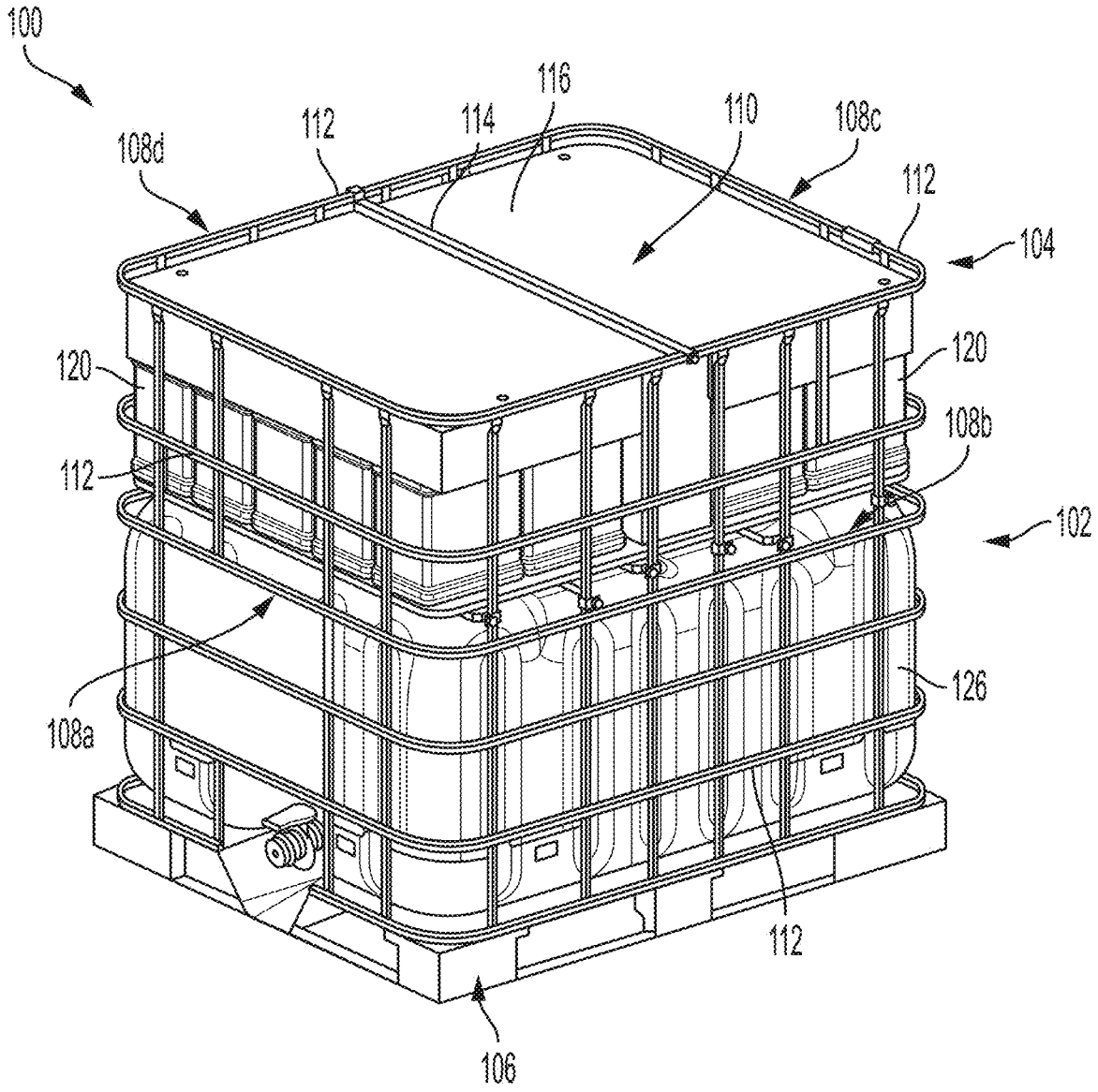
FIG. 1 is a perspective view of an example embodiment of a packaging assembly including one or more aspects of the present disclosure.

Example embodiments of the present disclosure generally relate to packaging assemblies, and to methods of making and using such packaging assemblies. In some aspects of the present disclosure, the packaging assemblies include multiple regions (e.g., areas, zones, containers, holders, supports, compartments, etc.) for holding, containing, supporting, etc. different components (e.g., solid components, liquid components, other fluid components, etc.), together within the same packaging assemblies. The different components, then, are housed separately within the packaging assemblies (e.g., in one or more of the multiple regions, etc.), for example, in arrangements (e.g., layered arrangements, side-by-side arrangements, arrangements of multiple separate containers, etc.) that provide stability and transportability, etc. of the components. As such, the packaging assemblies can be used, for example, for storing, shipping, dispensing, and/or otherwise making available the multiple components, together, to users.

In some aspects of the present disclosure, the components included in the packaging assemblies are configured for use together in various mixtures, compounds, formulations, etc. (broadly, are usable together to form products). For example, the components provided together in the packaging assemblies may include active ingredients, concentrated chemicals, fluids, etc. for use in liquid or fluid formulations (e.g., agricultural chemical formulations such as herbicides, pesticides, fertilizers, etc.; food-based formulations; formulations for soluble or insoluble products in general; etc.). As such, the packaging assemblies may generally include or may generally provide kits for making the formulations (e.g., where all of the components required for the formations are included together in the packaging assemblies, or kits, for subsequent mixing, spraying, applying, etc.; etc.). The components included together in the packaging assemblies, or kits, can then be combined (e.g., mixed, etc.), upon receipt of the packaging assemblies (or at desired times thereafter), to provide, create, generate, etc. the desired formulations (e.g., after shipment, after storage, prior to application and/or selling of the formulations, etc.). In this way, the individual components are maintained separately within the same packaging containers, but are available to combine, for example, just prior to desired use, etc. This may help ensure efficacy and reliability of the components in their intended use within the formulations when the formulations are ultimately created and used (e.g., this may help prevent unwanted separation of the components in the formulation over time (which may occur with pre-mixed formulations that are then transported, stored, etc.), may help maintain suspension of the components in the formulation at time of use, may help maintain efficacy of the components in the formulation at time of use, etc.).

Example embodiments will now be described more fully with reference to the accompanying drawings. The description and specific examples included herein are intended for purposes of illustration only and are not intended to limit the scope of the present disclosure.

FIGS. 1-11 illustrate an example embodiment of a packaging assembly 100 (e.g., a co-product packaging assembly, a co-package delivery system, a kit, etc.) including one or more aspects of the present disclosure. The packaging assembly 100 is configured to hold, retain, store, etc. multiple components together within the assembly 100. The components being held in the packaging assembly 100 may include liquid components, other fluid components (e.g., gases, vapors, etc.), solid components, and/or any combination thereof (e.g., depending on the formulation(s) being made, etc.). The components included in the packaging assembly 100, then, in this example embodiment, may be subsequently combined, as desired, to produce a formulation. For example, upon receipt of the packaging assembly 100 (or at desired times thereafter), the components included in the packaging assembly 100 may be combined (e.g., mixed, etc.) to provide, create, generate, etc. the formulation (e.g., after shipment, after storage, prior to application and/or selling of the formulation, etc.).

As shown in FIG. 1, the packaging assembly 100 generally includes a first compartment 102 (broadly, a first region) and a second compartment 104 (broadly, a second region). The first (or lower in the illustrated embodiment) compartment 102 is configured to hold, contain, store, etc. a first component (or multiple different components) of a fluid formulation (e.g., a fluid, an active ingredient, a chemical, etc.). The second (or upper in the illustrated embodiment) compartment 104 is configured to hold, contain, store, etc. a second (e.g., a different, etc.) component (or multiple different components) of the fluid formulation (e.g., another fluid, active ingredient, chemical, etc.). The first and second compartments 102 and 104 are generally usable together and may include components of the fluid formulation that are not optimized or shelf-stable if offered together as pre-mixes. In other embodiments, the first and second compartments 102 and 104 may include components that are not generally usable together (e.g., are not combined to provide, create, generate, etc. a formulation, are each individually shelf-stable, etc.). Further, in some embodiments, one packaging assembly (e.g., packaging assembly 100) may include components for multiple formulations, and/or may include more than two compartments.

When the first and second components are included in the compartments 102 and 104, the first and second components can then be shipped and/or stored together in the packaging assembly 100 in a manner that separates the first component in the first compartment 102 from the second component in the second compartment 104. The first and second components can subsequently be mixed, as desired, to provide the fluid formulation. As such, the packaging assembly 100 can provide stability for the fluid formulation, for example, by separating the components in the first compartment 102 and the second compartment 104, as desired, during handling, shipping, and/or storing, while enabling the co-packaged products (e.g., chemicals, etc.) to be shipped, stored, and otherwise made available together, subsequently, for mixing, spraying, applying in a singular and self-contained apparatus (i.e., the packaging assembly 100).

The packaging assembly 100 also includes a base 106. In the illustrated embodiment, the first compartment 102 is generally disposed above the base 106 (e.g., within a footprint defined by the base 106, etc.) and the second compartment 104 is generally disposed above the first compartment 102 (e.g., within a footprint defined by the base 106, etc.). In addition, in the illustrated embodiment, the base 106 generally includes a pallet configuration to enable the packaging assembly 100, for example, to be moveable by a pallet jack, a forklift, etc. In some examples, such pallet configuration may include generally similar features, spacings, supports, feet, etc. around the base 106 (e.g., such that the base is generally symmetric or not, etc.), whereby the base 106 may be similarly accessed by a pallet jack, a forklift, etc. from any side and then moveable from each side to thereby move the packaging assembly 100 (e.g., the base 106 may be a four-way pallet, etc.), etc. In this way, in the illustrated embodiment, the base 106 configures the packaging assembly 100 as a multi-product pallet pack. That said, it should be appreciated that the base may have other configurations in other embodiments (e.g., a generally flat base configured to be lifted by devices other than pallet jacks, forklifts, etc.).

The packaging assembly 100, in this embodiment, generally includes a cuboid shape (e.g., a box or cube shape, etc.) having the base 106, four sidewall sections 108*a*, 108*b*, 108*c*, and 108*d* (or sidewalls), and an upper (or top) portion 110. Sidewall sections 108*a*, 108*b*, 108*c*, and 108*d* each generally include a plurality of bars 112 (e.g., positioned vertically and horizontally, etc.) to form the sidewall section (or sidewall), and which together then form (or define) a self-contained cage or frame (or boundary) around the first compartment 102 and the second compartment 104. The sidewall sections 108*a*, 108*b*, 108*c*, and 108*d* provide containment, improved strength (e.g., compression strength, etc.), structural integrity, and improved stackability, for example, to the packaging assembly 100 to enable vertical stacking of the packaging assembly 100 with multiple other packaging assemblies (e.g., up to three packaging assemblies, more than three packaging assemblies, etc.) without compromising the structural integrity of the packaging assembly 100 and/or the contents included within the packaging assembly 100. In the illustrated embodiment, the sidewall sections 108*a*, 108*b*, 108*c*, and 108*d* generally provide the strength and structural support for the packaging assembly 100. In doing so, in this example embodiment, the sidewall sections 108*a*, 108*b*, 108*c*, and 108*d* minimize and/or inhibit any load from being placed on the interior contents of the packaging assembly 100 (e.g., contents included within the first and second compartments 102 and 104; etc.). In this way, the interior contents of the packaging assembly 100 (included in the first and second compartments 102 and 104) are nonstructural components and carry little to no load, so as to be protected and/or inhibited from damage (e.g., during transport, when the packaging assembly 100 and other packaging assemblies are stacked on either other, when other assemblies are stacked on the packaging assembly 100, etc.).

It should be appreciated that the sidewall sections 108*a*, 108*b*, 108*c*, and 108*d* of the packaging assembly 100 (e.g., the bars 112, etc.) may be formed from any suitable material within the scope of the present disclosure including, for example, metal such as steel or iron, high-strength plastic, combinations thereof, etc. In addition, the packaging assembly 100 may include other shapes and/or configurations within the scope of the present disclosure, for example, having a greater or lesser number of sidewall sections, sidewall sections forming other than box shapes (e.g., round or cylindrical shapes having single sidewalls, polygonal shapes having multiple sidewalls, etc.), sidewall sections formed or constructed in manners other than using bars, etc. What's more, in some embodiments, the sidewall sections 108*a*, 108*b*, 108*c*, and 108*d* of the packaging assembly 100 may be generally consistent with an intermediate bulk container (IBC) cage housing and may form a cage of a generally standard size, for example, a 275 gallon IBC cage, etc.

The upper portion 110 of the packaging assembly 100 includes a crossbar 114 (broadly, a cross member) and a lid 116. The crossbar 114 is disposed generally above the lid 116 and, in the illustrated embodiment, is coupled (e.g., fastened, etc.) to sidewall section 108*b* and sidewall section 108*d* (and specifically an upper bar thereof). In other embodiments, the crossbar 114 may be coupled to other ones of the sidewall sections (e.g., sidewall sections 108*a*, 108*c*, etc.) and/or multiple crossbars may be included. The crossbar 114 may provide additional strength and structural integrity for the packaging assembly 100 (and the frame or cage or boundary defined thereby) and may be formed from any suitable material, such as that of the sidewall sections 108*a*, 108*b*, 108*c*, and 108*d* (e.g., metal, high-strength plastic, combinations thereof, etc.) or not. The lid 116 is disposed generally above the second compartment 104 and substantially covers the second compartment 104 (and contents or components included therein). The lid 116 also provides improved resistance to or shelter from environmental exposure (e.g., direct outdoor environmental exposure, etc.) for the contents/components of the packaging assembly 100. The lid 116 can be formed from any suitable material within the scope of the present disclosure including, for example, a water-resistant or waterproof material, metal, plastic, combinations thereof, etc.

Figure 2:
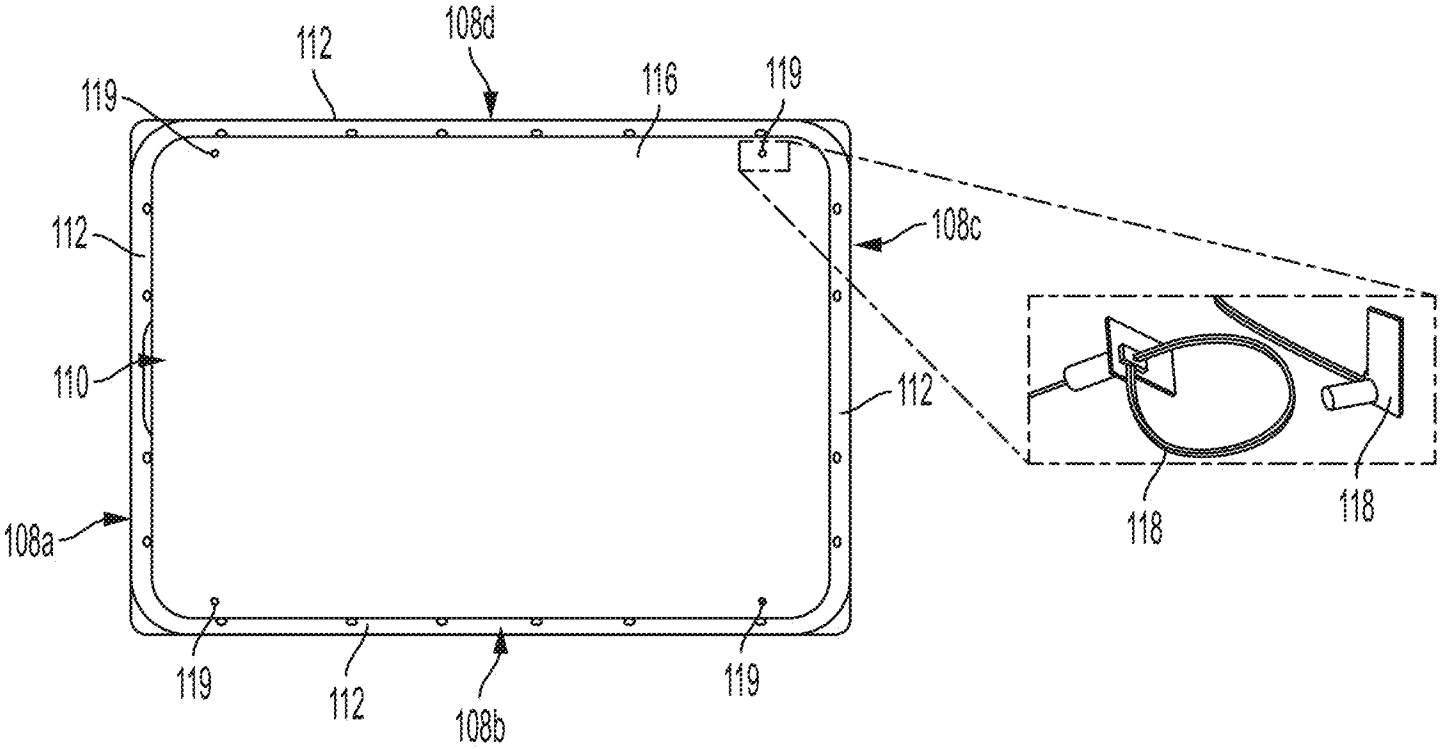
FIG. 2 is a top view of the packaging assembly of FIG. 1, with securing devices of the assembly removed and illustrated separately.

With additional reference to FIG. 2, a securing device 118 (e.g., a tamper-evident security seal, etc.) is included in the upper portion 110 of the packaging assembly 100 to securely couple the lid 116 to the sidewall sections 108*a*, 108*b*, 108*c*, and 108*d*, as desired. In particular in the illustrated embodiment, four securing devices 118 are included (only two are shown), with each configured to extend through an opening 119 in the lid 116 and around an adjacent one of the sidewall sections 108*a*, 108*b*, 108*c*, and 108*d* (e.g., around a bar 112 thereof, etc.) (thereby securing the lid to the sidewall sections 108*a*, 108*b*, 108*c*, and 108*d* of the packaging assembly 100 (and to the packaging assembly 100 itself)). When secured, the securing devices 118 must then be removed in order to access the compartments 102 and 104 of the packaging assembly 100 (and the contents/components included therein). As such, the securing devices 118 may additionally provide evidence that the packaging assembly 100 has not been altered or tampered with (e.g., that the components within the compartments 102 and/or 104 have not been altered or tampered with, etc.) prior to use (e.g., to ensure that the packaging assembly 100 (e.g., the cage and contents within the cage, etc.) is tamper secure, etc.).

In the illustrated embodiment, the securing devices 118 include tamper-evident cable (or zip) ties that are threaded through the openings 119 of the lid 116 and around (or through) a bar 112 of the adjacent one of the sidewall sections 108*a*, 108*b*, 108*c*, and 108*d* such that the securing devices 118 substantially prevent removal of the lid 116 from the packaging assembly 100 when attached. Users may remove the securing devices 118 (e.g., by cutting, etc.) when desired to access the compartments 102 and 104 (and the contents included therein) (e.g., to mix the components included in the second compartment 104 with the components included in the compartment 102, etc.). It should be appreciated that other types of securing devices may be used in connection with coupling the lid 116 to the sidewalls 108*a*, 108*b*, 108*c*, and/or 108*d* of the packaging assembly 100 in other embodiments (e.g., key or combination locks, etc.).

Also in the illustrated embodiment, the first compartment 102 and the second compartment 104 of the packaging assembly 100 are each configured to hold, retain, support, etc. (e.g., are provided with room for, are sized with room for, etc.) at least one container for the component(s) to be included in the respective compartments 102 and 104.

Figure 3:
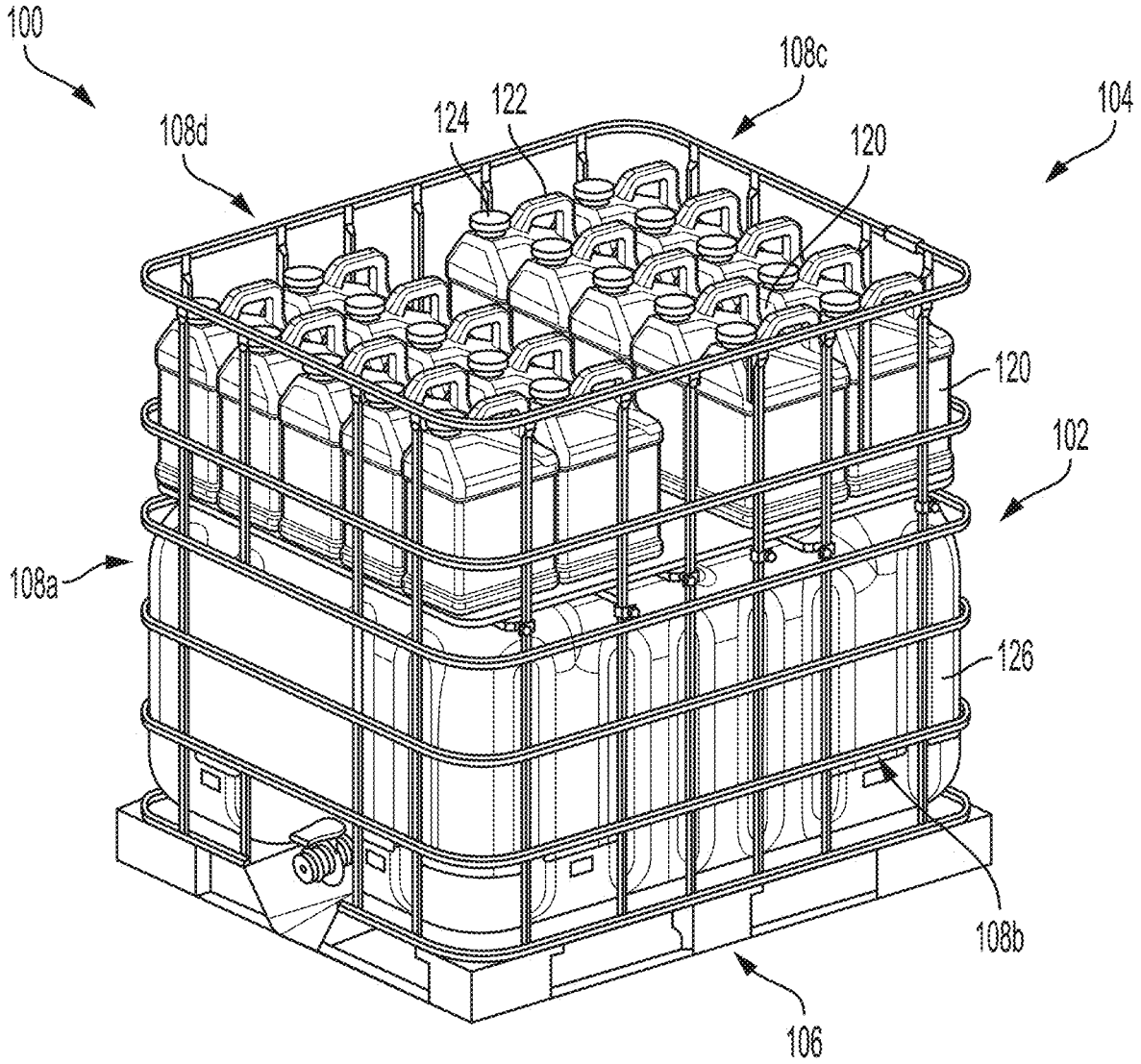
FIG. 3 is the perspective view of FIG. 1 with a top portion and lids of the packaging assembly removed in order to illustrate containers of the packaging assembly (e.g., in an upper compartment, etc.)

As shown in FIG. 3, for example, the second compartment 104 includes a plurality of containers 120 for containing the second component (e.g., a liquid component in this example, etc.). The containers 120 are configured as bottles each including a handle 122 to facilitate lifting and/or handling of the container 120 and a cap 124 which is removable to provide access to the second component within the container 120. While depicted as bottles in the illustrated embodiment, the second compartment 104 may include one or more of any suitable containers within the scope of the present disclosure including, for example, tanks, bottles, jerricans, bags, jugs, drums, etc. The containers 120 can be formed from any suitable material within the scope of the present disclosure, including, for example, glass, plastic, metal, etc. or any combination thereof. While a plurality of the same containers 120 are included in the second compartment 104 in the illustrated embodiment and while each contains the same second component, it should be appreciated that in other embodiments the second compartment 104 may include multiple containers 120 that include two or more different components and/or multiple different types of containers. In addition, while a plurality of containers 120 are depicted in the second compartment 104, in other embodiments, the second compartment 104 may only include one container (e.g., filled with one component, etc.).

Figure 4:
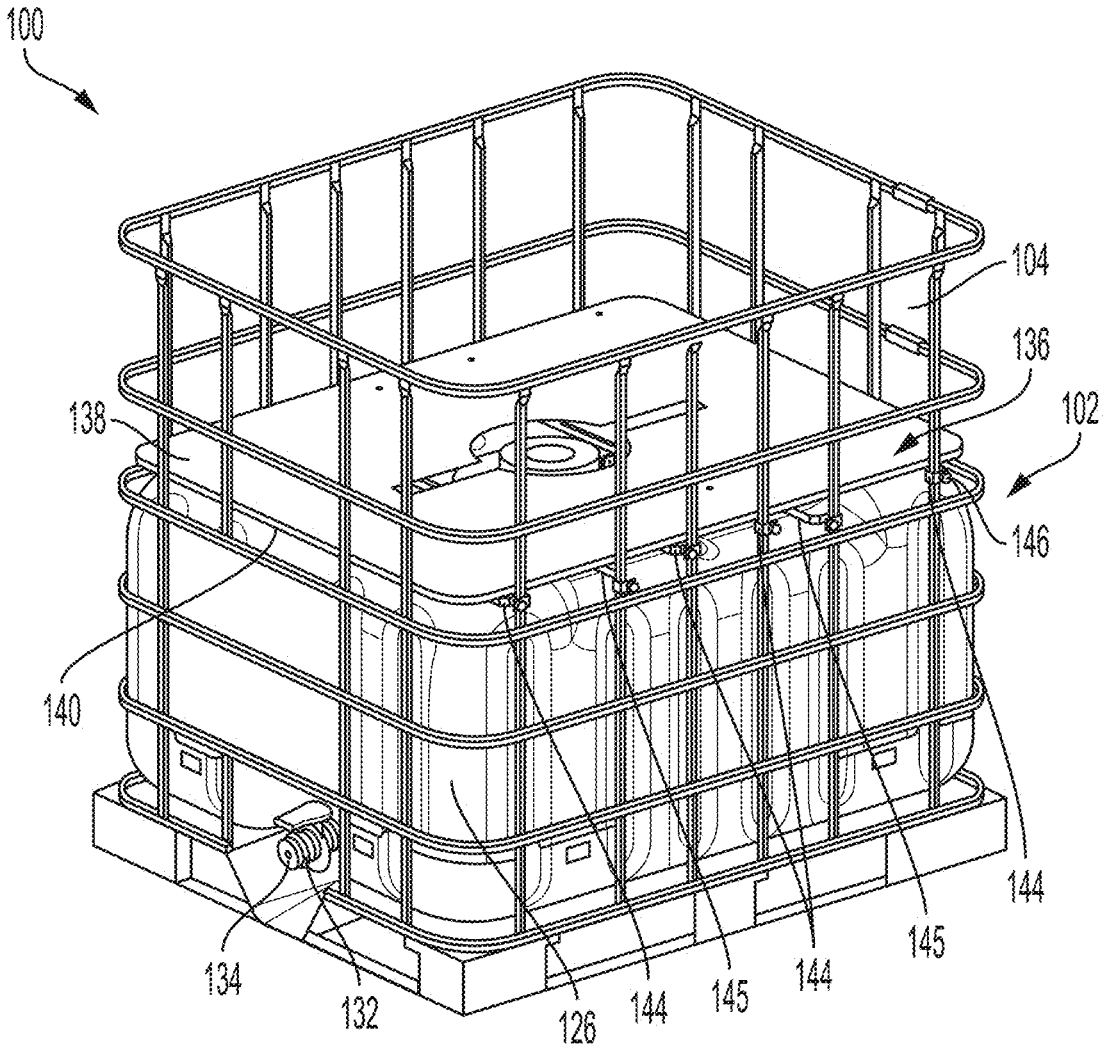
FIG. 4 is the perspective view of FIG. 3 with the containers of the packaging assembly (e.g., in the upper compartment, etc.) removed in order to illustrate a platform and another container of the packaging assembly (e.g., in a lower compartment, etc.)
Figure 5:
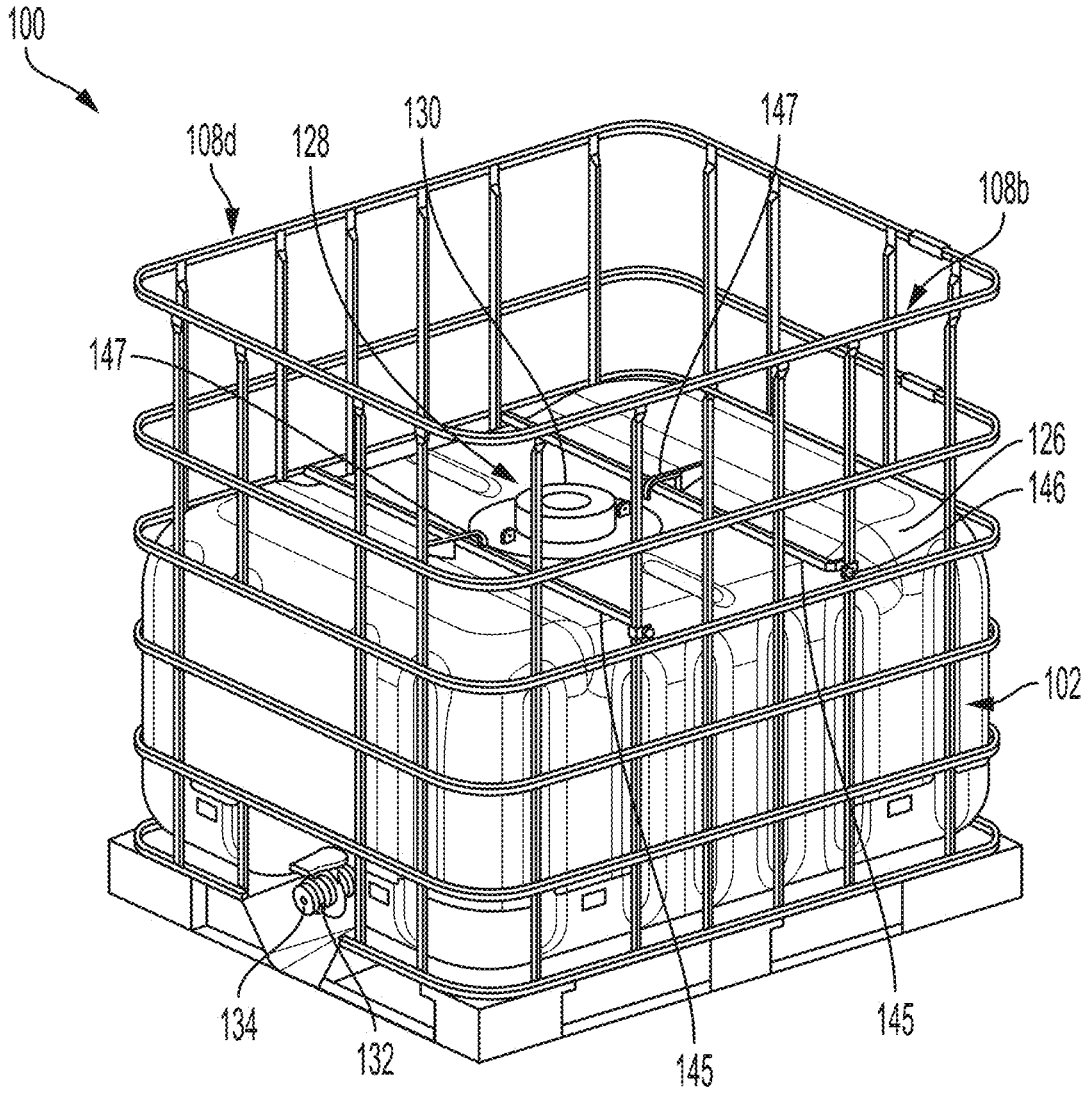
FIG. 5 is the perspective view of FIG. 4 with the platform of the packaging assembly removed.

With additional reference to FIGS. 4 and 5, the first compartment 102 in the illustrated embodiment includes a container 126, configured as a tank, for containing the first component (e.g., a liquid component in this example, etc.). The container 126 includes an opening 128 positioned toward a top of the container 126. The opening 128 is configured for receiving fluid into the container 126 (e.g., the first component for containment in the container 126, the second component included in one or more of the containers 120 from the second compartment 104 for mixing with the first component, etc.). A cap 130 is removably coupled to the opening 128 and allows for selectively covering and uncovering the opening 128. The container 126 also includes a valve 132 (broadly, an opening) positioned at a side of the container 126 and generally towards a bottom of the container 126. The valve 132 is configured (e.g., may be selectively opened and closed, etc.) for dispensing fluid (e.g., the first component, the mixed formulation of the first and second components, etc.) from the container 126 (and more generally, from the first compartment 102). A cap 134 is removably coupled to the valve 132 and allows for selectively covering and uncovering the valve 132. That said, the container 126 may be formed from any suitable material within the scope of the present disclosure, including, for example, glass, plastic, metal, etc. or any combination thereof. In addition, while only one container 126 containing one component is included in the first compartment 102 in the illustrated embodiment, it should be appreciated that in other embodiments, the first compartment 102 may include multiple containers each containing the same or different components (e.g., for use in one or more formulations, etc.). Further, although depicted as including a tank in the illustrated embodiment, the first compartment 102 may include any suitable one or more containers (having configurations other than that of a tank) in other embodiments, including, for example, one or more bottle, jerrican, bag, jug, drum, etc.

It should be appreciated that any desired containers and/or combination of containers may be included in the first and/or second compartments 102 and/or 104 of the packaging assembly 100. In addition, the configuration and/or size of the container(s) included in the first compartment 102 and/or the container(s) included in the second compartment 104 may be based on a desired ratio of the components included therein, for instance, in a mixed formulation, such as, for example, 1:1, 1:2, 2:1, 3:1, 50:1, 1:1:1, etc. Further, the configuration and/or size of the container(s) included in the first compartment 102 and/or the container(s) included in the second compartment 104 may also (or alternatively) be based on an overall capacity of the packaging assembly 100, etc.

Figure 6:
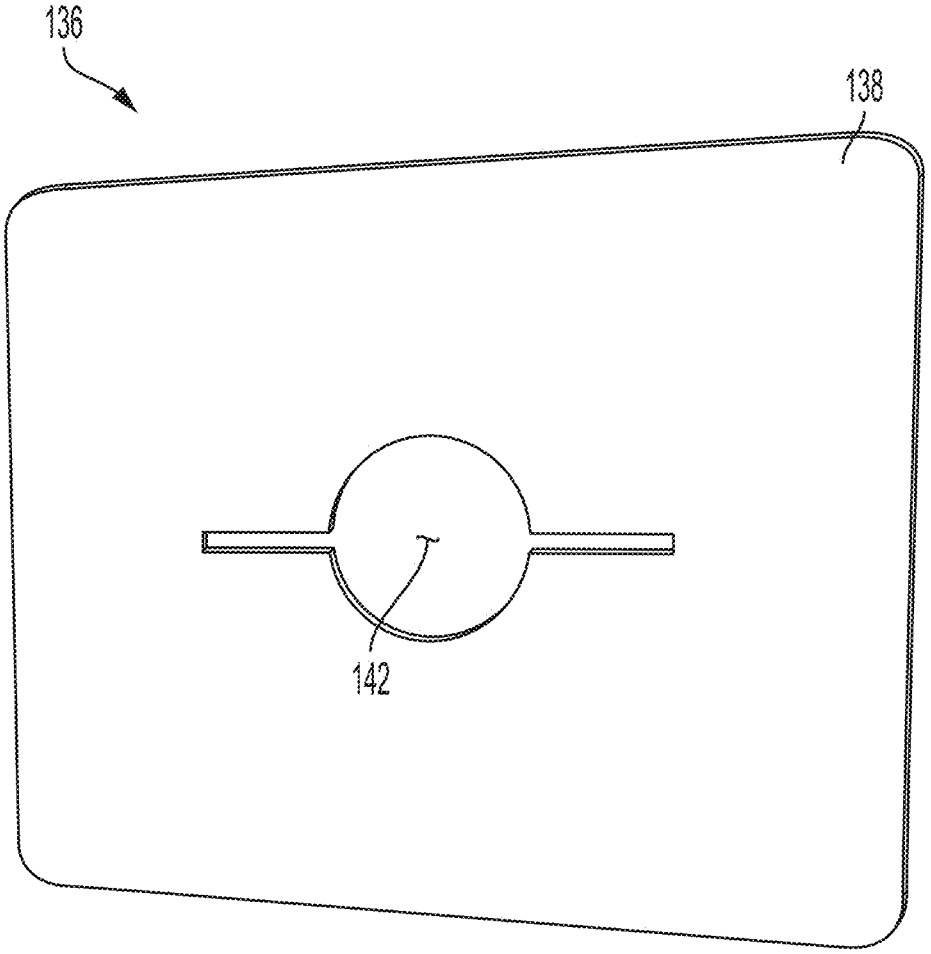
FIG. 6 is a top perspective view of the platform of the packaging assembly of FIG. 1.
Figure 7:
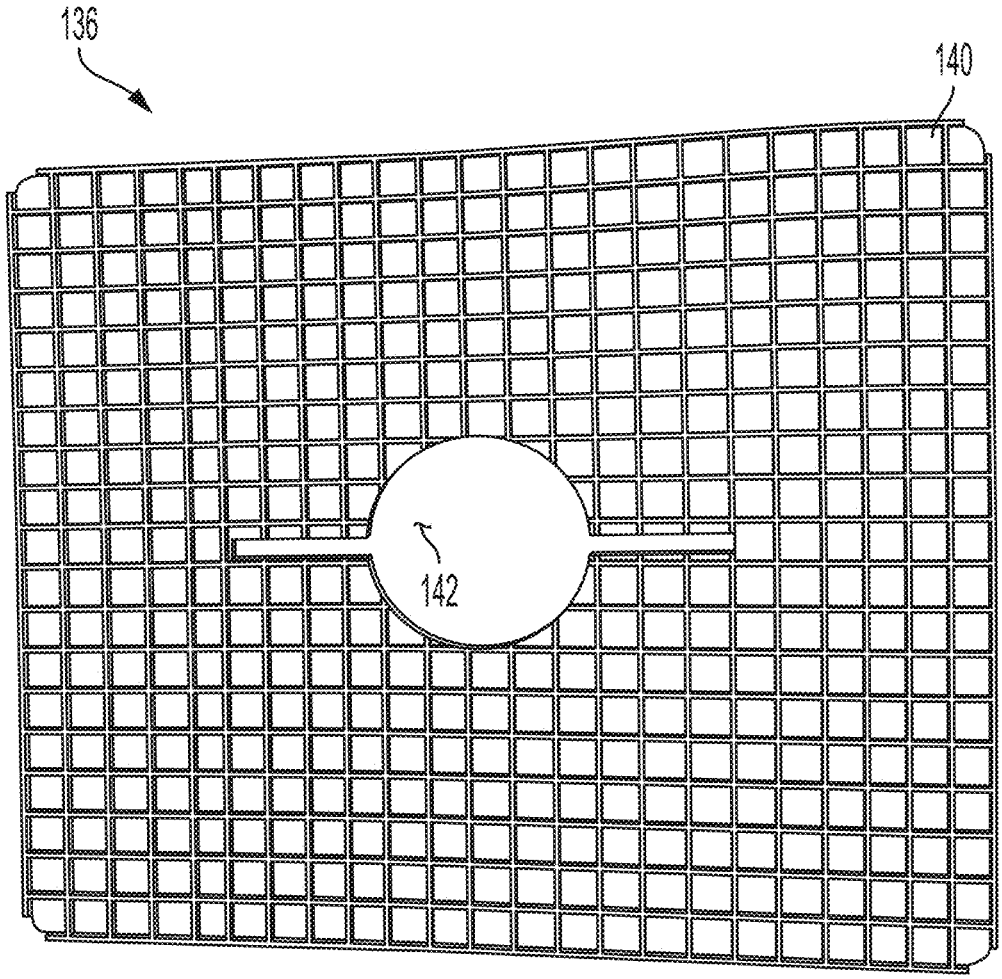
FIG. 7 is a bottom perspective view of the platform of FIG. 6.
Figure 8:
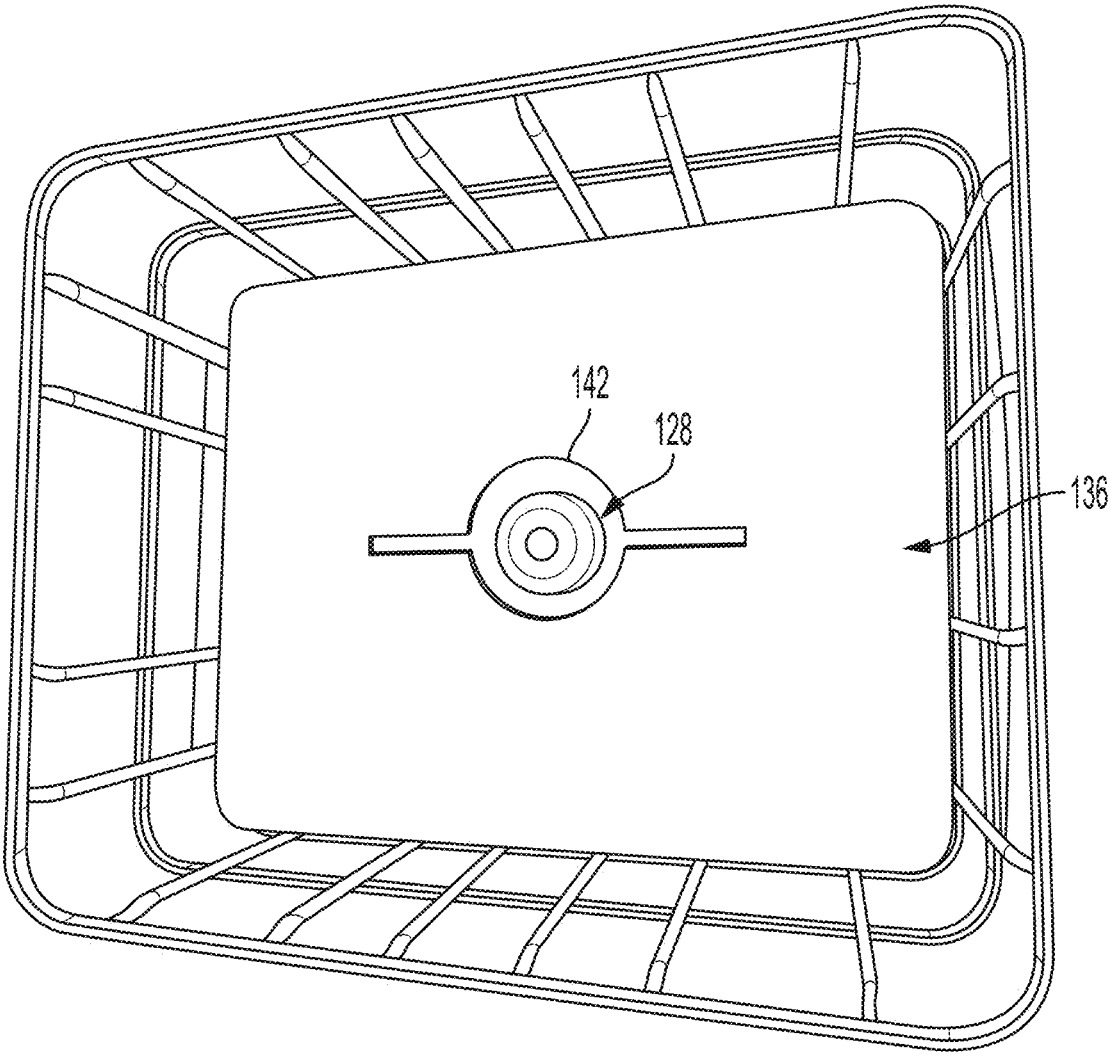
FIG. 8 is another top perspective view of the platform of FIG. 6, shown included in the packaging assembly (e.g., generally over the container in the lower compartment, etc.)

With further reference to FIGS. 6-8, to separate the first compartment 102 from the second compartment 104, a platform 136 (broadly, a divider) is positioned between the first compartment 102 and the second compartment 104 (e.g., positioned between containers 120 and container 126, etc.). The platform 136 permits the packaging assembly 100 to include the containers 120 separately from the container 126 (e.g., to include the containers 120 in the second compartment 104 and container 126 in the first compartment 102, etc.). In this way, the platform 136 generally isolates the second compartment 104, and the containers 120 included therein, from the first compartment 102 and the container 126. The platform 136 has an upper surface 138 and a lower surface 140 and is configured to support the contents of the second compartment 104 (e.g., containers 120, etc.) (e.g., such that the contents of the first compartment 102 do not support the load of the contents of the second compartment 104, etc.). In the illustrated embodiment, the lower surface 140 includes a reinforcing grid pattern to provide improved strength and structural integrity for the platform 136. And, in some embodiments, the upper surface 138 of the platform 136 may include multiple recesses (not shown) corresponding to the number of containers 120, which are configured to receive, house, seat, partially retain, etc. the containers 120 therein on the platform 136. The platform 136 may be formed from any suitable material within the scope of the present disclosure including, for example, metal, plastic such as high density poly ethylene (HDPE), combinations thereof, etc.

The platform 136 includes an opening 142 to facilitate access of the container 126 in the first compartment 102 from the second compartment 104, without need to remove the platform 136. The opening 142 of the platform 136 generally aligns with the opening 128 of the container 126 included in the first compartment 102 (see, FIGS. 4 and 8). This facilitates filling of the container 126 with component(s) (e.g., the first component for containment within container 126, the second component from one or more of the containers 120 from the second compartment 104 for mixing with the first component, etc.) through the opening 142 of the platform and through the opening 128 of the container 126 (e.g., without requiring removal of the platform 136, potentially without requiring removal of the containers 120 from the second compartment 104, etc.). As such, the alignment of the opening 142 of the platform 136 and the opening 128 of the container 126 allows for generally inline filling, closing, etc. of the container 126 in the first compartment 102 of the packaging assembly 100, while potentially permitting the containers 120 (or at least some of the containers 120) to remain in the second compartment 104.

As shown in FIG. 4, internal crossbars 144 (broadly, cross members) are included within the packaging assembly 100 (and connected to bars 112 of the sidewall sections 108*b* and 108*d*) and are disposed generally below the platform 136 to provide support for the platform 136 and additional stability to the sidewall sections 108*a*, 108*b*, 108*c*, and 108*d* (and the configuration thereof). In particular, the lower surface 140 of the platform 136 is placed on (e.g., directly on, etc.) the internal crossbars 144 to maintain the positioning of the platform 136 within the packaging assembly 100 (e.g., generally above the container 126, etc.) (e.g., to inhibit the platform 136 from resting on the container 126; to inhibit a load associated with the containers 120 from resting on the container 126; to direct a load from the containers to the sidewall sections 108*a*, 108*b*, 108*c*, and 108*d*, etc.). By positioning the platform 136 on the internal crossbars 144 (which are connected to the sidewall sections 108*b* and 108*d*) instead of directly on the container 126, the platform 136 generally transfers a load associated with the containers 120 in the second compartment 104 to the sidewall sections of the packaging assembly 100. In this way, the sidewall sections 108*b* and 108*d* (or, in other embodiments, sidewall sections 108*a* and 108*c*, etc.) provide the support for the upper compartment 104 and the containers 120 via the platform 136 and the internal crossbars 144. The load distribution of the packaging assembly 100, as provided by the platform 136 and the internal crossbars 144, may thus protect the integrity and/or rigidity of the container 126 included in the first compartment 102 (e.g., prevent the container 126 from collapsing and/or expanding outward over time, for example, due to a load associated with the containers 120 included in the second compartment 104; etc.). In other embodiments, the platform 136 may be coupled directly to one or more of the sidewall sections 108*a-d* of the assembly 100.

In the illustrated embodiment, the internal crossbars 144 are coupled (e.g., fastened, etc.) to the sidewall sections 108*b* and 108*d* (or, in other embodiments, to sidewall sections 108*a* and 108*c*, etc.), for example, with fasteners 146. In some embodiments, end portions of the internal crossbars 144 may include hooks to enable the internal crossbars 144 to be hooked on, draped over, supported by, etc. the bars 112 of the sidewall sections 108*b* and 108*d* (or, in other embodiments, to sidewall sections 108*a* and 108*c*, etc.) (e.g., without requiring fasteners 146, etc.). In addition in the illustrated embodiment, four internal crossbars 144 are included within the packaging assembly 100 extending between the sidewall sections 108*b* and 108*d*. However, greater or fewer internal crossbars 144 may be included in the assembly 100 within the scope of the present disclosure (extending between any different ones of the sidewall sections 108*a*, 108*b*, 108*c*, and 108*d*, etc.).

Additionally in the illustrated embodiment, as shown with additional reference to FIG. 5, internal members 145 (broadly, cross members) pass through a retaining loop 147 of the container 126, for example, to ensure stability of the container 126 (e.g., to fix the container 126 within the first compartment 102, etc.). In particular in the illustrated embodiment, two internal members 145 are included within the packaging assembly 100 extending between the sidewall sections 108*b* and 108*d*. However, greater or fewer internal members 145 may be included in the assembly 100 within the scope of the present disclosure (extending between any different ones of the sidewall sections 108*a*, 108*b*, 108*c*, and 108*d*, etc.). In some embodiments, the packaging assembly 100 may include one or more internal crossbars and/or members configured to both support the platform 136 and to also engage (or otherwise secure) the container 126 (e.g., that pass through the retaining loop 147 of the container 126, etc.).

Figure 9:
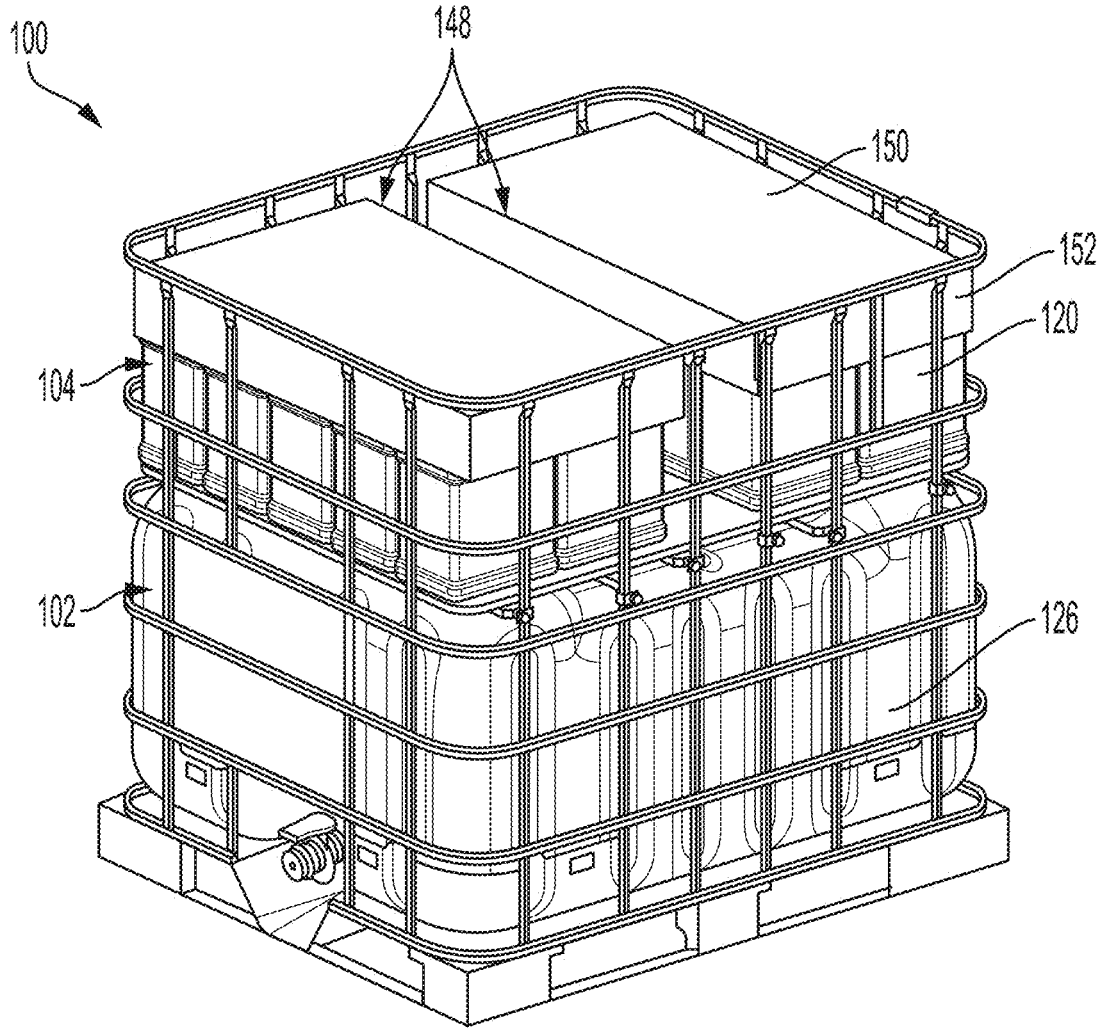
FIG. 9 is the perspective view of FIG. 1 with the top portion of the packaging assembly removed to illustrate the lids positioned over the containers (e.g., in the upper compartment, etc.)
Figure 10:
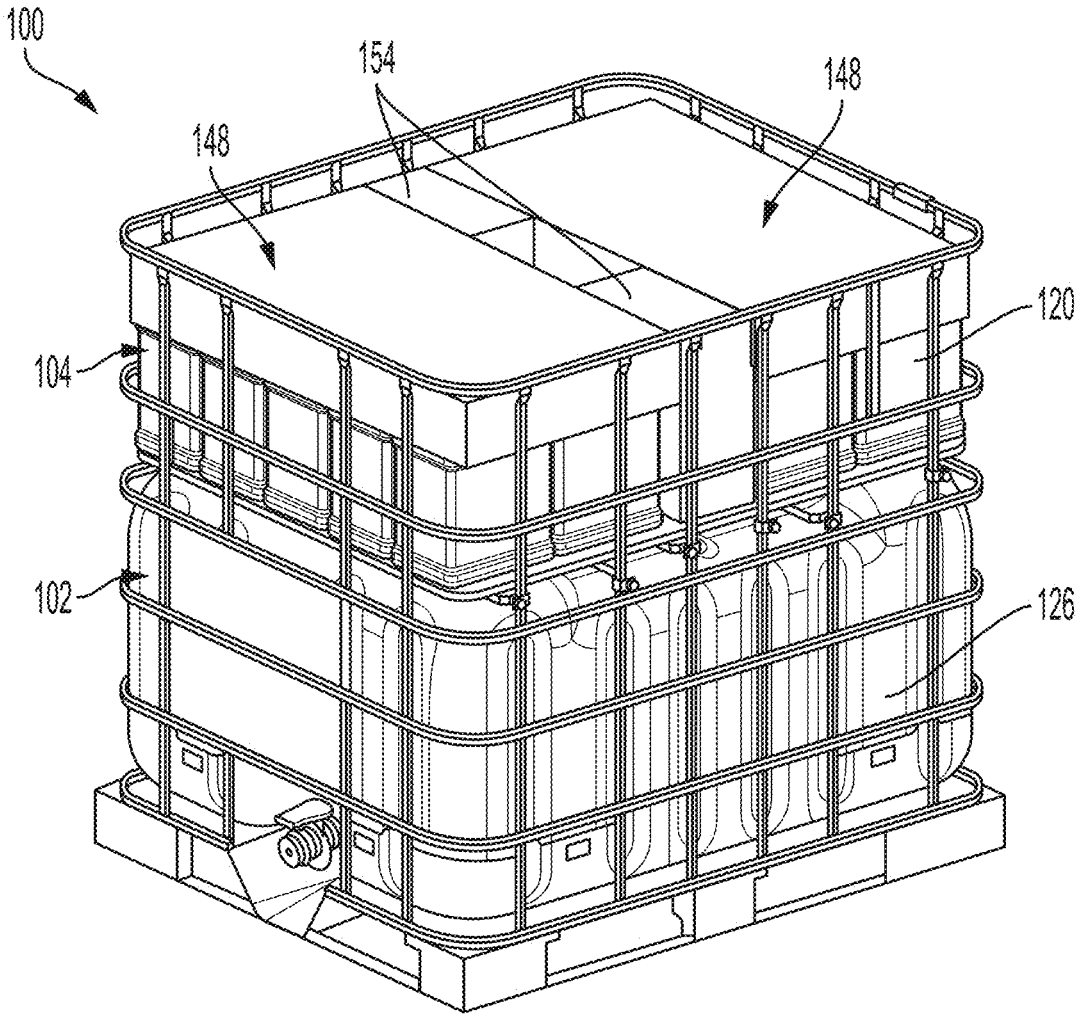
FIG. 10 is the perspective view of FIG. 9 with fillers shown positioned between groups of the containers (e.g., in the upper compartment, etc.) of the packaging assembly.
Figure 11:
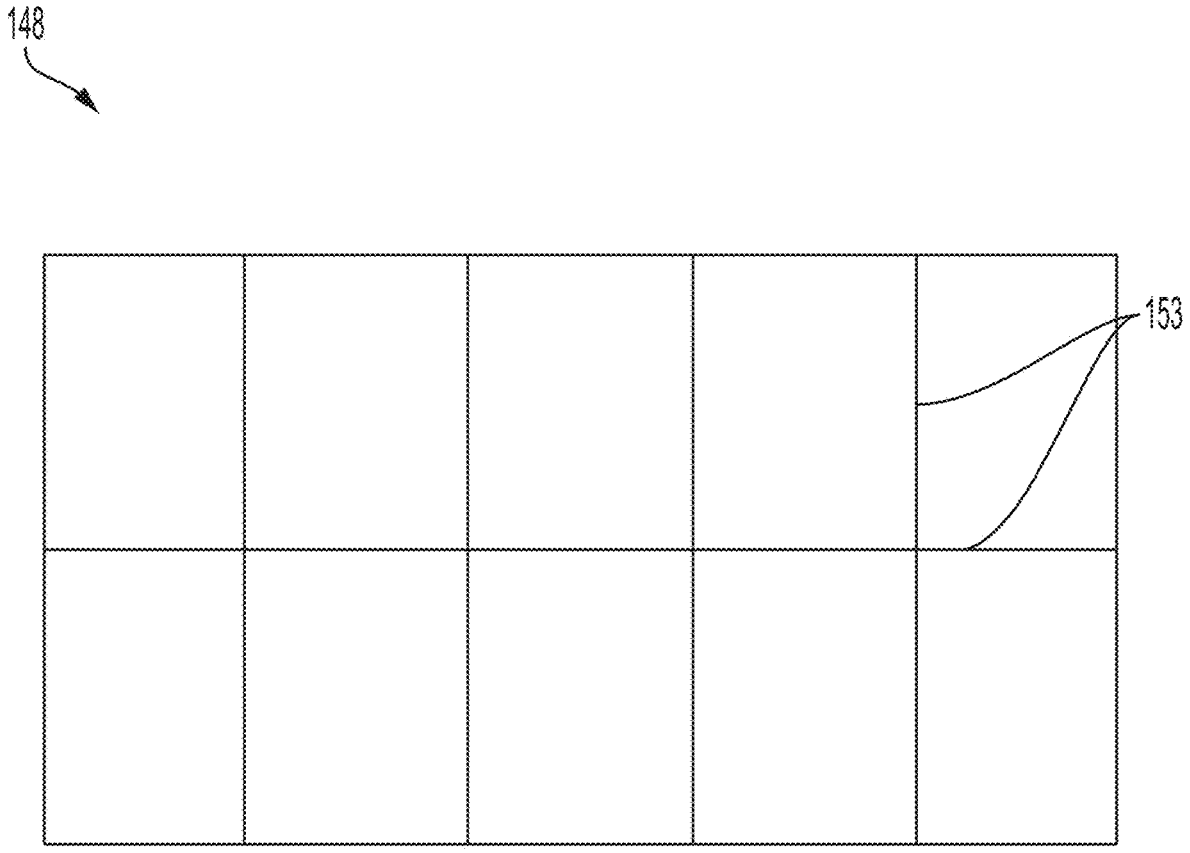
FIG. 11 is a bottom view of one of the lids of the packaging assembly of FIG. 1.

With reference now to FIGS. 9-11, to inhibit (or at least decrease or minimize) movement of the multiple containers 120 included in the second compartment 104 (e.g., to help secure the containers 120, etc.), lids 148 (e.g., tray lids, covers, dividers, etc.) are positioned over or about the containers 120. In the illustrated embodiment, one of the lids 148 covers half of the containers 120 and another one of the lids 148 covers the other half of the containers 120. And, while two lids 148 are depicted, a greater or fewer number of lids 148, covering a greater or lesser portion of containers 120, may be included within the scope of the present disclosure. Moreover, in the illustrated embodiment, the lids 148 are unable to be removed from the packaging assembly 100 when the packaging assembly 100 is closed and/or secured (e.g., when the securing devices 118 are attached to the lid 116 and the sidewall sections 108*a*, 108*b*, 108*c*, and 108*d*, etc.). As such, the lids 148 may additionally provide evidence that the packaging assembly 100 has not been altered or tampered with (e.g., that the components within the compartments 102 and/or 104 have not been altered or tampered with, etc.) prior to use (e.g., to ensure that the packaging assembly 100 is tamper secure, etc.) based on the inability to remove the lids 148 without opening the packaging assembly 100.

The lids 148 generally include a top 150 and walls 152. When installed over the containers 120, the walls 152 partially surround (e.g., partially enclose, etc.) the containers 120 to minimize movement of the containers 120 and/or retain placement of the containers 120 on the platform 136. In addition, the lids 148 each include interior dividers 153 configured to separate adjacent ones of the containers 120 (FIG. 11). In this way, the lids 148 maintain spacing of the containers 120 included within the first compartment 102 (e.g., maintains a gap or space or distance between the containers, etc.) as well as a position of the containers 120. Further, by maintaining such position of the containers 120 within the first compartment 102, the lids 148 enable (or otherwise facilitate) access to the first compartment 102 (and the opening 128 of the container 126) through the opening 142 of the platform 136 (e.g., to allow inline filling of the container 126 included in the first compartment 102, etc.). The lids 148 may be formed from any suitable material within the scope of the present disclosure including, for example, fiberboard (e.g., corrugated fiberboard, etc.), plastic, Styrofoam, combinations thereof, etc.

To additionally maintain a spacing (e.g., a gap, etc.) between groups of the containers 120 in the second compartment 104, for access to the first compartment 102 via the opening 142 of the platform 136, the second compartment 104 additionally includes fillers 154 (e.g., blocks, spacers, etc.) positioned between the containers 120 (FIG. 10). The fillers 154 may help inhibit or prevent the containers 120 included in the second compartment 104 from moving or other displacement and/or damage during transport and shipping. The fillers 154 may be formed from any suitable material within the scope of the present disclosure including, for example, fiberboard (e.g., corrugated fiberboard), plastic, Styrofoam, combinations thereof, etc.

Figure 12:
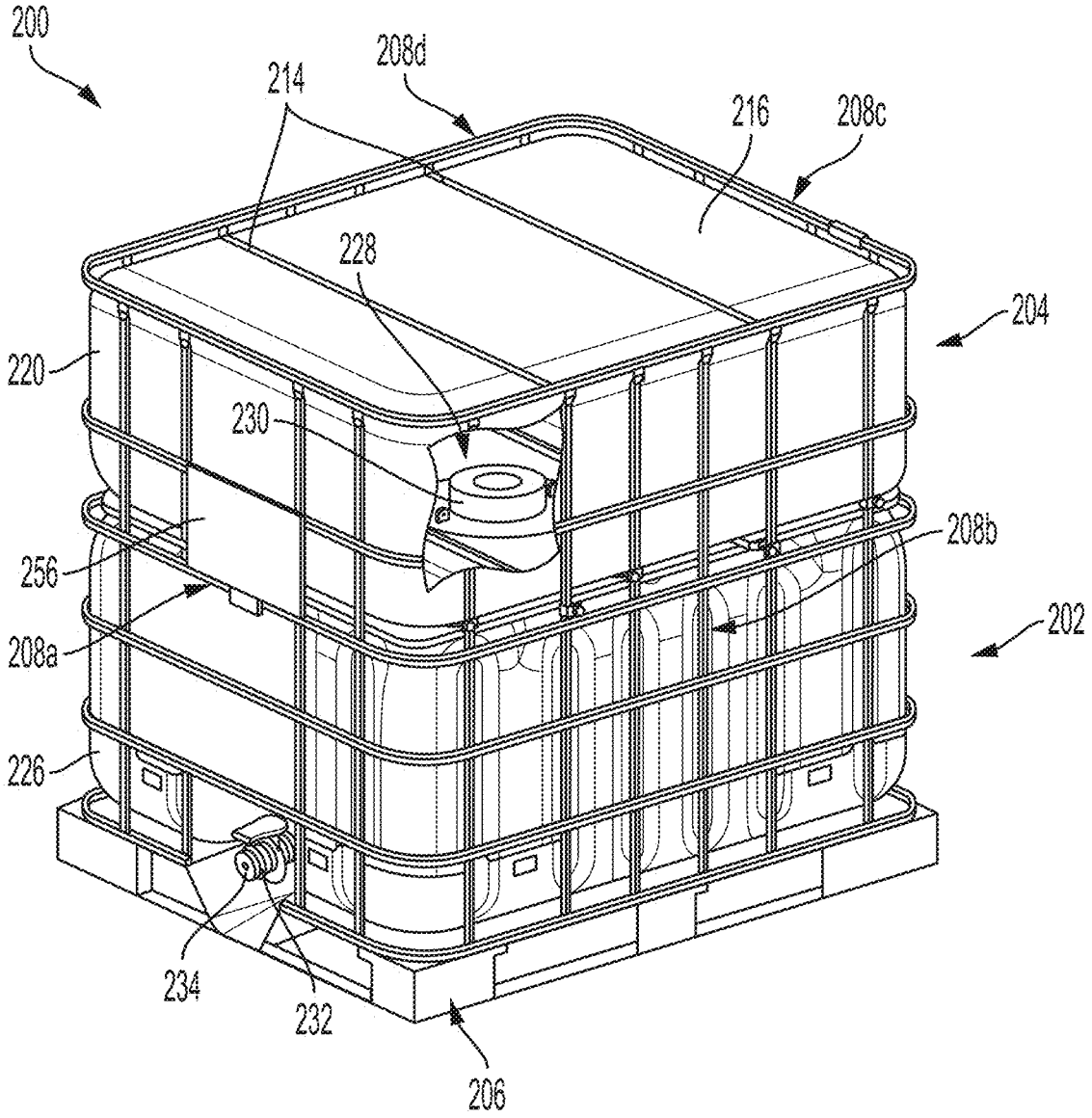
FIG. 12 is a perspective view of another example embodiment of a packaging assembly including one or more aspects of the present disclosure.

FIG. 12 illustrates another example embodiment of a packaging assembly 200 including one or more aspects of the present disclosure. The packaging assembly 200 of this embodiment is substantially similar to the packaging assembly 100 previously described and illustrated in FIGS. 1-11. For example, the packaging assembly 200 includes a first compartment 202, a second compartment 204 (generally disposed above the first compartment 202 in the illustrated embodiment), a base 206, and sidewall sections 208*a-d* coupled to the base 206 (and which at least partially define the first and second compartments 202 and 204). And, a pair of crossbars 214 are included at the top of the packaging assembly 200 and are coupled (e.g., fastened, etc.) to the sidewalls 208*b* and 208*d* (e.g., to secure a lid 216 on the assembly 200, etc.).

In this example embodiment, the first compartment 202 includes a single tank 226 for a first component and the second compartment 204 includes a single tank 220 for a second component. As such, in this example embodiment, rather than including multiple containers in the second compartment 204, only one tank (i.e., tank 220) is included. In connection therewith, the tank 220 may generally be able to hold a larger volume of the second component in the compartment 204 than multiple smaller containers. This allows for a variety of differing dosage capabilities for formulations made from the first component and the second component (e.g., a 1:1 dosage ratio of the first component and the second component, a 1:2 ratio, etc.). Accordingly, by way of the packaging assembly 200, it can be seen that the present disclosure provides substantial flexibility in changing volume ratios of formulations (by way of varying containers included in the compartments 202 and 204, etc.).

Both tanks 220 and 226 of the packaging assembly 200 are similar to container 126 of the packaging assembly 100 and include a similar configuration. In particular, the tank 226 includes an opening 228 positioned toward a top of the tank 226 and configured for receiving one or more components into the tank 226. A cap 230 is removably coupled to the opening 228 and allows for selectively covering and uncovering the opening 228. The tank 226 also includes a valve 232 (broadly, an opening), and a cap 234 associated with the valve 232, positioned at a side of the tank 226 and generally towards a bottom of the tank 226. In some embodiments, a cover may be included in sidewall 208*a* to protect and/or provide access to the valve 232 (e.g., similar to cover 256). The tank 220 is the same as the tank 226 and, although not shown, likewise includes an opening positioned toward a top of the tank 220 (under the lid 216) and a valve or opening positioned at a side of the tank 220 and generally towards a bottom of the tank 220 (generally behind cover 256).

Figure 13:
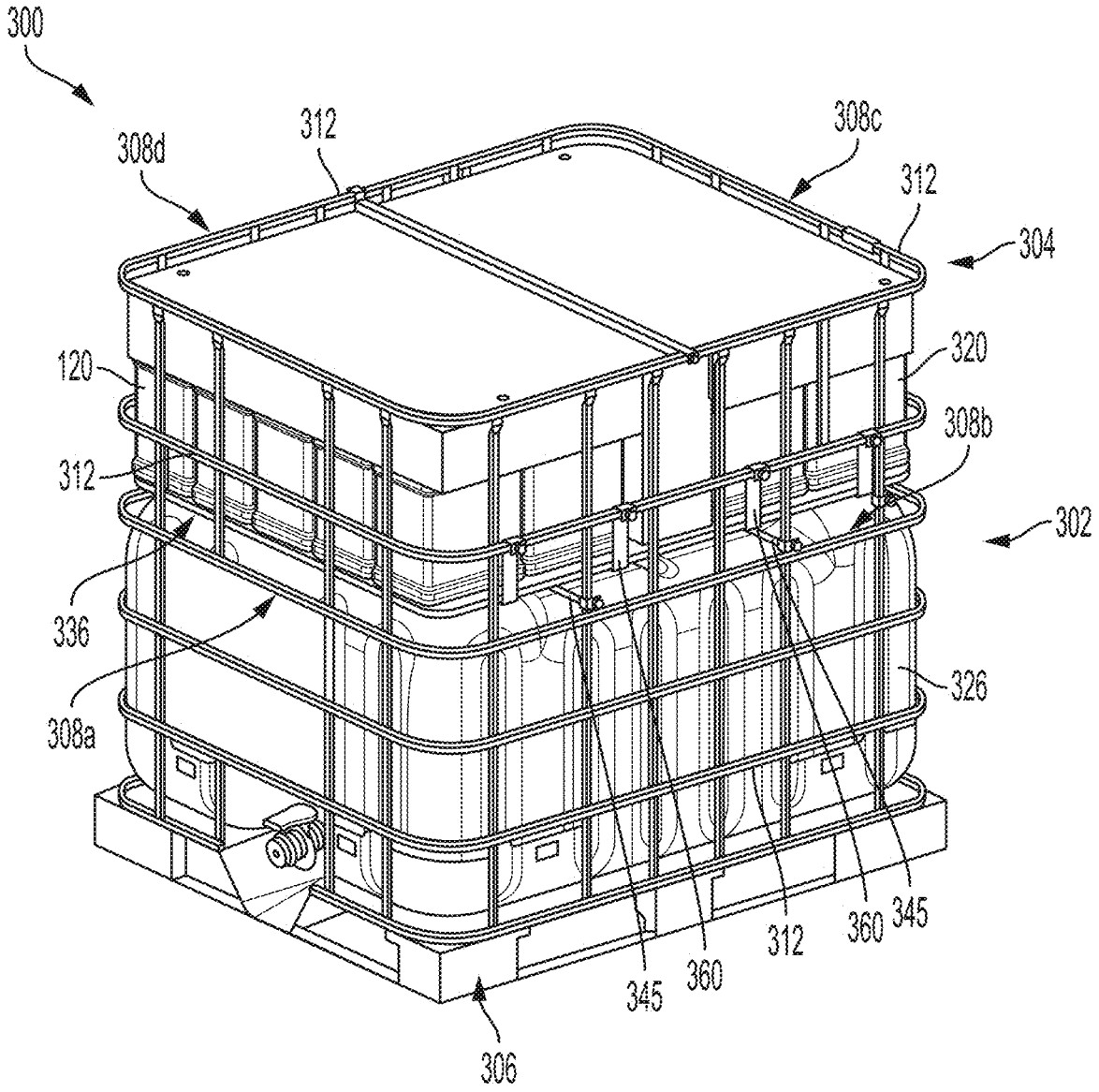
FIG. 13 is a perspective view of still another example embodiment of a packaging assembly including one or more aspects of the present disclosure.
Figure 14:
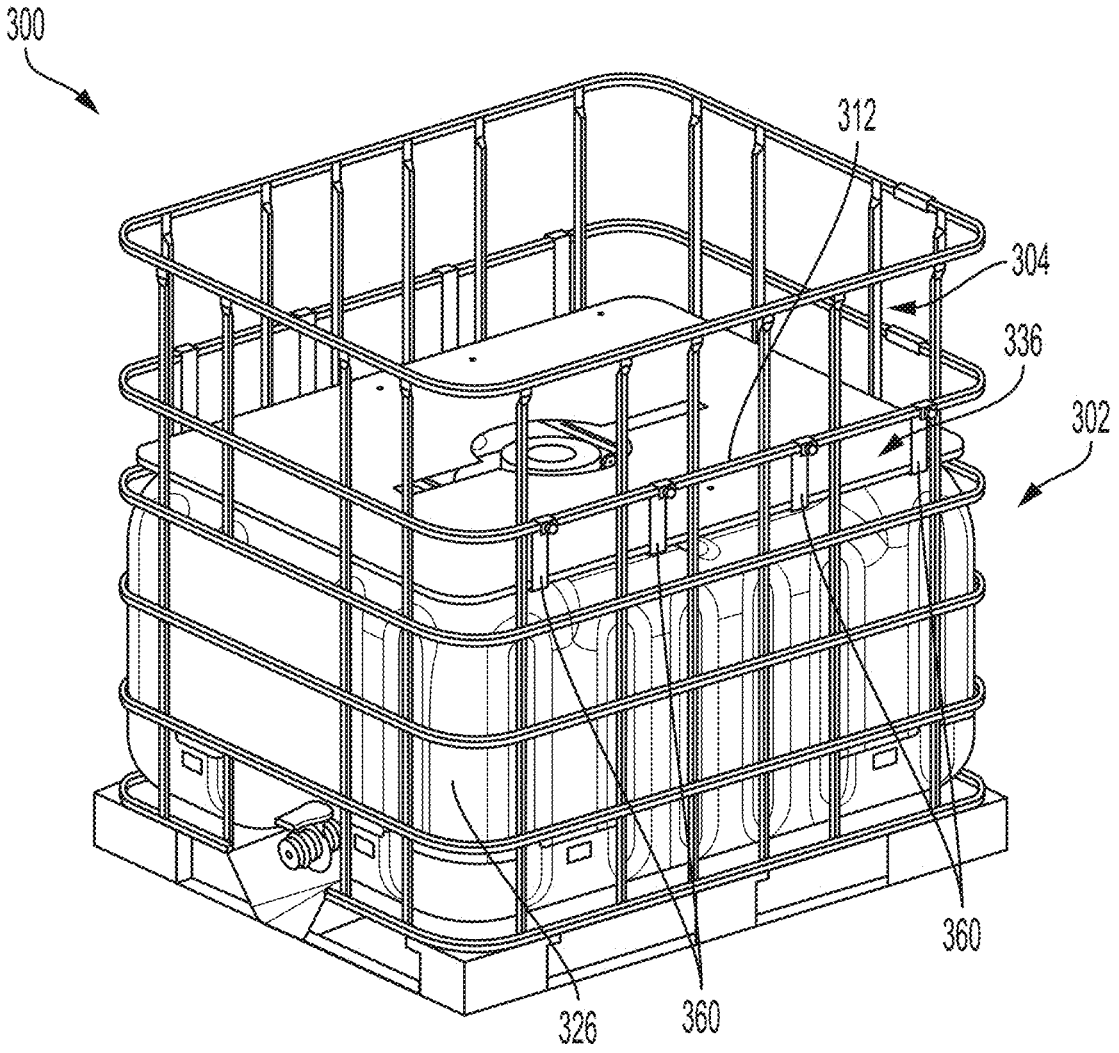
FIG. 14 is the perspective view of FIG. 13 with a top portion, lids, and containers (e.g., in an upper compartment, etc.) of the packaging assembly removed.
Figure 15:
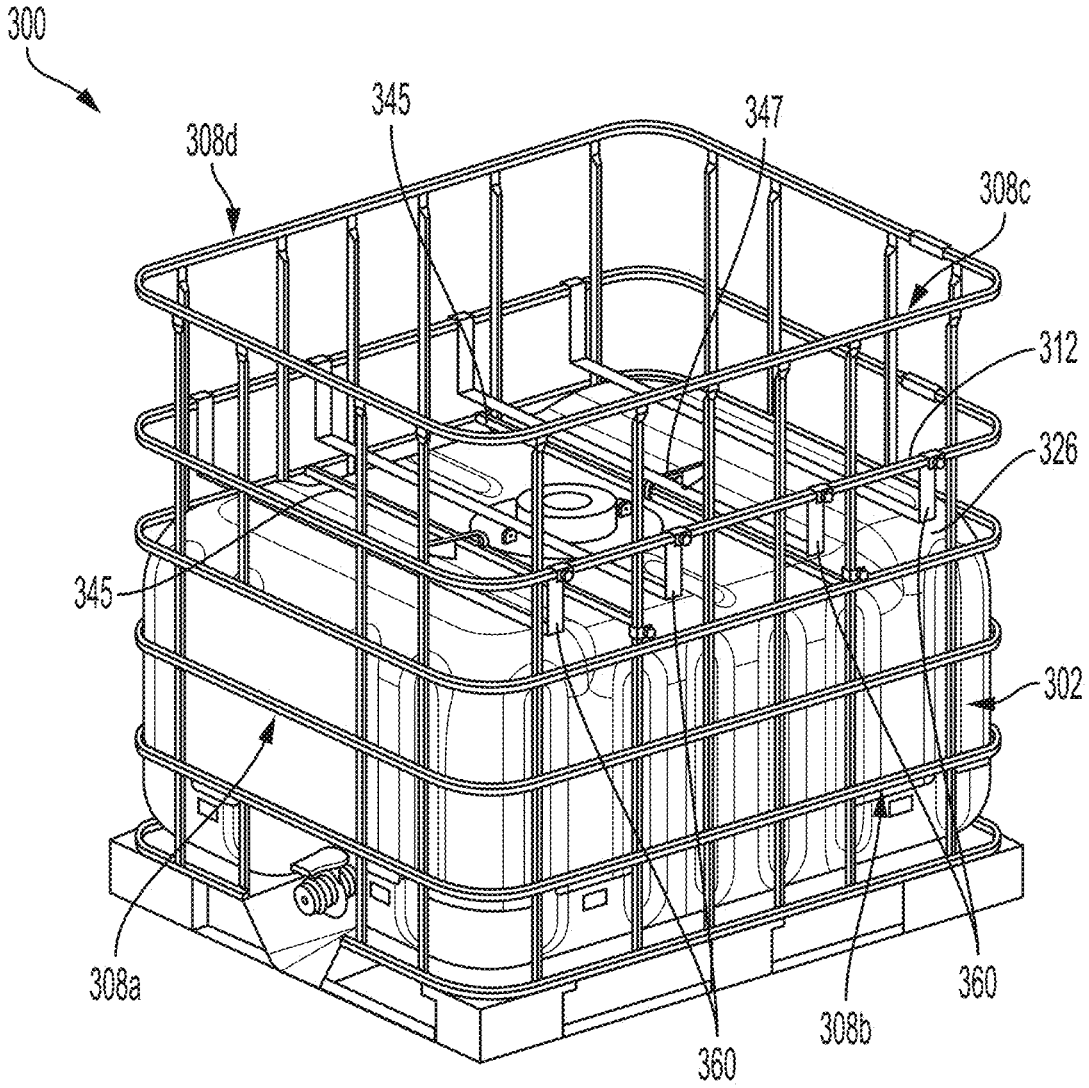
FIG. 15 is the perspective view of FIG. 14 with a platform of the packaging assembly removed in order to illustrate internal cross members of the packaging assembly.

FIGS. 13-15 illustrate another example embodiment of a packaging assembly 300 including one or more aspects of the present disclosure. The packaging assembly 300 of this embodiment is substantially similar to the packaging assembly 100 previously described and illustrated in FIGS. 1-11. For example, the packaging assembly 300 includes a first compartment 302, a second compartment 304 (generally disposed above the first compartment 302 in the illustrated embodiment), a base 306, and sidewall sections 308*a-d* coupled to the base 306. The sidewall sections 308*a-d* at least partially define the first and second compartments 302 and 304 and each include a plurality of bars 312 positioned horizontally and vertically. And, a platform 336 is positioned between the first compartment 302 and the second compartment 304 to separate the first compartment 302 from the second compartment 304. The packaging assembly 300 further includes internal members 345 which are coupled (e.g., fastened, etc.) to the sidewall sections 308*b* and 308*d* (e.g., to pass through retaining loops 347 of container 326 included in the first compartment 302, to generally secure the container 326 within the first compartment 302, etc.).

In this example embodiment, the packaging assembly 300 additionally includes internal crossbars 360 (broadly, cross members) coupled (e.g., fastened, hooked, etc.) to the bars 312 of the sidewall sections 308*b* and 308*d* and configured to support the platform 336 (e.g., in addition to, separate from, etc. the members 345; etc.). The crossbars 360 include a generally flat surface to support the platform 336 (e.g., include rectangular bars, etc.). To maintain a separation between the container 326 included in the first compartment 302 and the platform 336, the crossbars 360 are positioned generally above the members 345 (e.g., to inhibit the platform 136 from resting on the container 326 included in the first compartment 302, to inhibit a load associated with containers 320 included in the second compartment 304 from resting on the container 326 included in the first compartment 302, etc.). In the illustrated embodiment, each end of each of the crossbars 360 includes a hook portion to couple the crossbars 360 to the sidewall sections 308*b* and 308*d* (e.g., to horizontal bars 312 of the sidewall sections 308*b* and 308*d*, etc.). In particular, the crossbars 360 are hooked on, draped over, supported by, etc. the horizontal bars 312 of the sidewall sections 308*b* and 308*d* at the hook portions (e.g., with fasteners (as in the illustrated embodiment), or without fasteners, etc.). By positioning the platform 336 on the crossbars 360, then, instead of directly on the container 326 included within the first compartment 302, any load associated with the second compartment 304 (e.g., containers 320, etc.) is transferred to the sidewall sections 308*b* and 308*d* of the packaging assembly 300 (e.g., to prevent damage to container 326 included in the first compartment 302, etc.).

With that said, the packaging assemblies 100, 200, 300 are each described as including two compartments for holding, containing, etc. components (e.g., the first compartment 102 and the second compartment 104 of assembly 100, etc.), and which, in each of the assemblies 100, 200, 300, are defined by a base (e.g., base 106, etc.), sidewall sections (e.g., sidewall sections 108*a*, 108*b*, 108*c*, and 108*d*; etc.), a platform (e.g., platform 136, etc.), and a top portion (e.g., top portion 110, etc.). In addition in the illustrated packaging assemblies 100, 200, 300, the holding compartments are provided in a layered arrangement (e.g., vertically, etc.) based on a horizontal positioning of the platform within the packaging assemblies 100, 200. In some embodiments, though, packaging assemblies may alternatively, or additionally, include other arrangements of compartments, such as a side-by-side arrangements, for example, by providing one or more vertical dividers within the packaging assemblies to define the compartments (e.g., in place of the horizontal platform 136, in addition to the platform 136 within the first and/or second compartments 102, 104; etc.). Further, in some embodiments, packaging assemblies may have only one compartment or more than two compartments (e.g., by including more than one platform and/or a vertical divider, by not including a platform or vertical divider, etc.).

In addition, in the present disclosure, the compartments of the packaging assemblies (e.g., compartments 102, 104, 202, 204, 302, 304, etc.) may each include one or more different components (in containers, etc.) that are usable together (e.g., that are mixable, etc.), for example, to form a formulation. By including such multiple different components together within a single packaging assembly (e.g., packaging assembly 100, packaging assembly 200, packaging assembly 300, etc.), correct metering of each component may be achieved by providing the correct dosage in the containers that are co-packaged and secured together within the packaging assembly (e.g., as a kit, etc.). This provides an improvement over pre-mixed formulations, for example, as the pre-mixed formulations may not have long term stability and may have other characteristics which provide difficulties in shipping and distributing the pre-mixed formulations.

Packaging assemblies of the present disclosure may also allow for efficient distribution, handling, and shipping of multiple products, together, while also enabling multi-tier warehouse stacking, storage, etc. (e.g., so as to satisfy warehouse stacking requirements, etc.). Packaging assemblies of the present disclosure may additionally enhance storage and shipping efficiency. For example, the packaging assemblies may be initially prepared for use (e.g., for filling with components, etc.) as unitary structures, whereby empty receptacles/containers are positioned within compartments of the packaging assemblies prior to filing the receptacles/containers with desired components. Thus, the prepared (but empty) packaging assemblies require less storage space because the receptacles/containers are already disposed within the assemblies. Further, the shapes of the containers of the packaging assemblies provide for compact, efficient stacking of the packaging assemblies (either filled with fluid or empty), for example, on pallets, thereby requiring less storage area for the packaging assemblies and providing efficient use of available storage space.

Moreover, packaging assemblies of the present disclosure may enhance storage and shipping efficiency for commercially available products (e.g., formulations, etc.) and ultimate use thereof. For example, some products may require enhancement, or otherwise require additional components to be added thereto, at or near the timeframe of their intended use and/or application. By maintaining the individual components separately within the same packaging containers, but still available together just prior to desired use, the packaging assemblies of the present disclosure may help prevent unwanted separation of the components in the formulation over time, may help maintain suspension of the components in the formulation at time of use, and may help maintain efficacy of the components in the formulation at time of use, etc. (as the components may be mixed, combined, etc. just prior to desired use, etc.). In this way, the packaging assemblies may enhance efficacy and reliability of the components in their intended use with the formulations when the formulations are ultimately created.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" as well as the phrase "at least one of" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper", "lower" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure.

What is claimed is:

1. A packaging assembly for two or more different product components, the packaging assembly comprising:

a base;

multiple sidewalls coupled to the base, the multiple sidewalls including first, second, third, and fourth sidewalls, wherein the first sidewall is disposed opposite the third sidewall, and wherein the second sidewall is disposed opposite the fourth sidewall;

a first compartment defined by the multiple sidewalls, the first compartment disposed adjacent the base and configured to hold at least a first component;

a second compartment defined by the multiple sidewalls, the second compartment disposed adjacent the first compartment, the second compartment configured to hold at least a second component;

a lid disposed generally over the second compartment;

at least one securing device configured to secure the lid to at least one of the multiple sidewalls;

a divider positioned between the first and second compartments; and multiple internal cross members coupled to the first and third sidewalls and located internally of the packaging assembly and spaced apart from the second and fourth sidewalls, the multiple internal cross members configured to support the divider;

wherein each end of each of the multiple internal cross members includes a hook configured to couple said internal cross member to the first and third sidewalls.

2. The packaging assembly of claim 1, further comprising:

at least oen first container positioned within the first compartment, the at least oen first container configured to hold at least the first component; and at least one second container positioned within the second compartment, the at least one second container configgured to hold at least the second component.

3. The packaging assembly of claim 2, wherein the at least one first container includes at least one of a tank, a bottle, a jerrican, a bag, a jug, and a drum, and/or wherein the at least one second container includes at least one of a tank, a bottle, a jerrican, a bag, a jug, and a drum.

4. The packaging assembly of claim 2, wherein the at least one first container includes a tank, and wherein the at least one second container includes multiple containers.

5. The packaging assembly of claim 1, further comprising a container positioned in the first compartment and configured to hold the at least a first component within the first compartment, wherein the divider includes an opening to facilitate access between the first compartment and the second compartment through the divider, without need to remove the divider from the packaging assembly, and wherein the first container includes an opening aligned with the opening of the divider.

6. The packaging assembly of claim 1, further comprising:

at least one cross member disposed generally above the lid and coupled to at least one of the multiple sidewalls, and multiple containers positioned within the second compartment below the lid, the multiple containers configured to hold the at least a second component within the second compartment, wherein the lid includes interior dividers configured to maintain a spacing between each of the multiple containers within the second compartment.

7. The packaging assembly of claim 1, wherein each of the multiple sidewalls includes a plurality of bars; and wherein the multiple sidewalls form a cage at least partially surrounding the first compartment and the second compartment.

8. The packaging assembly of claim 1, further comprising the first component and the second component;

wherein the first component and the second component are different components; and wherein the first component and the second component are mixable together to form a liquid formulation.

9. A packaging assembly for two or more different product components, the packaging assembly comprising:

a base;

multiple sidewalls coupled to the base;

at least one first container configured to hold a first component, the at least one first container supported by the base and disposed within a boundary defined by the sidewalls, wherein the at least one first container includes a valve configured to dispense the first component from the first container, and wherein at least one of the sidewalls defines an opening at the base, the valve of the at least one first container positioned in alignment with the opening of the at least one of the sidewalls;

at least one second container configured to hold a second component, the at least one second container disposed within the boundary defined by the sidewalls; and a divider positioned generally between the at least one first container and the at least one second container, the divider configured to support the at least one second container on the divider;

wherein the divider includes an opening to facilitate access through the divider to an aligned opening of the at least one first container, without need to remove the divider from the packaging assembly.

10. The packaging assembly of claim 9, further comprising:

a lid disposed over the at least one second container;

at least one securing device configured to secure the lid to the sidewalls; and at least one cross member disposed generally above the lid and coupled to at least one of the sidewalls for use in retaining the lid on the packaging assembly.

11. The packaging assembly of claim 9, further comprising at least one internal cross member coupled to at least one of the sidewalls and configured to support the divider.

12. The packaging assembly of claim 9, wherein the at least one first container includes multiple containers, and/or wherein the at least one second container includes multiple containers.

13. The packaging assembly of claim 9, wherein the at least one second container includes multiple containers; and wherein the packaging assembly further comprises:

a spacer positioned between the multiple containers; and one or more covers disposed over the multiple containers.

14. The packaging assembly of claim 9, further comprising the first component and the second component; and wherein the first component and the second component are different components and are usable together to form a product.

15. The packaging assembly of claim 9, further comprising at least one third container configured to hold a third component, the at least one third container disposed within the boundary defined by the sidewalls.

16. The packaging assembly of claim 9, wherein the at least one first container includes at least one of a tank, a bottle, a jerrican, a bag, a jug, and a drum; and/or wherein the at least one second container includes at least one of a tank, a bottle, a jerrican, a bag, a jug, and a drum.

17. A packaging assembly for two or more different product components, the packaging assembly comprising:

a base;

multiple sidewalls coupled to the base, the multiple sidewalls including first, second, third, and fourth sidewalls, wherein the first sidewall is disposed opposite the third sidewall, and wherein the second sidewall is disposed opposite the fourth sidewall;

a first compartment defined by the multiple sidewalls, the first compartment disposed adjacent the base and configured to hold at least a first component;

a second compartment defined by the multiple sidewalls, the second compartment disposed adjacent the first compartment, the second compartment configured to hold at least a second component;

a lid disposed generally over the second compartment;

at least one securing device configured to secure the lid to at least one of the multiple sidewalls; and a divider positioned between the first and second compartments, wherein the divider includes an opening to facilitate access between the first compartment and the second compartment through the divider, without need to remove the divider from the packaging assembly; and multiple internal cross members coupled to the first and third sidewalls and located internally of the packaging assembly and spaced apart from the second and fourth sidewalls, the multiple internal cross members configured to support the divider.

18. A packaging assembly for two or more different product components, the packaging assembly comprising:

a base;

multiple sidewalls coupled to the base, the multiple sidewalls including first, second, third, and fourth sidewalls, wherein the first sidewall is disposed opposite the third sidewall, and wherein the second sidewall is disposed opposite the fourth sidewall;

a first compartment defined by the multiple sidewalls, the first compartment disposed adjacent the base and configured to hold at least a first component;

a second compartment defined by the multiple sidewalls, the second compartment disposed adjacent the first compartment, the second compartment configured to hold at least a second component;

a lid disposed generally over the second compartment and including multiple internal dividers defined within the lid, the multiple internal dividers configured to maintain a spacing of containers positioned within the second compartment and configured to hold the at least a second component in the second compartment;

at least one cross member disposed generally above the lid and coupled to at least one of the multiple sidewalls;

a divider positioned between the first and second compartments; and multiple internal cross members coupled to the first and third sidewalls and located internally of the packaging assembly and spaced apart from the second and fourth sidewalls, the multiple internal cross members configured to support the divider.

* * * * *